US008054150B2

(12) United States Patent
Tsai et al.

(10) Patent No.: US 8,054,150 B2
(45) Date of Patent: Nov. 8, 2011

(54) MAGNETIC ELEMENT

(75) Inventors: Hsin-Wei Tsai, Taoyuan Hsien (TW); Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/323,289

(22) Filed: Nov. 25, 2008

(65) Prior Publication Data

US 2010/0039202 A1 Feb. 18, 2010

(30) Foreign Application Priority Data

Aug. 18, 2008 (TW) ..... 97131420 A

(51) Int. Cl.
*H01F 27/02* (2006.01)
*H01F 17/06* (2006.01)
*H01F 27/30* (2006.01)
*H01F 27/28* (2006.01)

(52) U.S. Cl. ..... 336/83; 336/178; 336/198; 336/222

(58) Field of Classification Search ..... 336/200, 336/178, 83, 131, 134, 182, 198, 212, 220, 336/222

See application file for complete search history.

(56) References Cited

U.S. PATENT DOCUMENTS

| | | | | |
|---|---|---|---|---|
| 3,851,287 | A * | 11/1974 | Miller et al. | 336/84 R |
| 6,876,161 | B2 * | 4/2005 | Chung | 315/368.28 |
| 7,061,358 | B1 * | 6/2006 | Yang | 336/198 |
| 2006/0197644 | A1 * | 9/2006 | Lin | 336/212 |
| 2007/0035375 | A1 * | 2/2007 | Yang | 336/212 |
| 2007/0273465 | A1 * | 11/2007 | Feng et al. | 336/212 |

FOREIGN PATENT DOCUMENTS

| | | | |
|---|---|---|---|
| JP | 55105310 A | * | 8/1980 |
| JP | 355105310 A | * | 8/1980 |

* cited by examiner

*Primary Examiner* — Anh Mai
*Assistant Examiner* — Mangtin Lian
(74) *Attorney, Agent, or Firm* — Kirton & McConkie; Evan R. Witt

(57) ABSTRACT

A magnetic element includes a conducting winding structure, first and second magnetic parts, and first and second side posts. The first and second magnetic parts have first and second central posts that are aligned with each other. The first side post is disposed on an edge of the first or second magnetic part. The second side post is disposed on another edge of the first or second magnetic part where no side post is disposed or the first side post is not aligned with. The conducting winding structure is sandwiched between the first and second magnetic parts. The first and second side posts are aligned with corresponding edges wherein no side post is disposed. Consequently, the overall height of the first and second central post is less than the height of the first or second side post and an air gap is defined between the first and second central post.

10 Claims, 9 Drawing Sheets

MAGNETIC ELEMENT

FIELD OF THE INVENTION

The present invention relates to a magnetic element, and more particularly to a magnetic element that is small-sized and easily assembled.

BACKGROUND OF THE INVENTION

Nowadays, magnetic elements such as inductors and transformers are widely used in many electronic devices to generate induced magnetic fluxes. Recently, since the electronic devices are developed toward minimization, the electronic components contained in the electronic products become small in size and light in weight. Therefore, the magnetic element and its conductive winding module are slim.

Take an inductor for example. FIG. 1A is a schematic exploded view of a conventional inductor. The inductor 1 principally comprises a bobbin 11, a magnetic core assembly 12 and a coil 13. The bobbin 11 has a winding section 111 for winding the coil 13 thereon. The bobbin 11 further has a channel 112 running through a center portion thereof. In addition, the bobbin 11 has several pins 113 extended from the bottom surface thereof and connected to the coil 13. By soldering the pins 113 on a circuit board (not shown), the inductor 1 is mounted on and electrically connected to the circuit board. The magnetic core assembly 12 includes a first magnetic part 121 and a second magnetic part 122. The first magnetic part 121 has a central post 121*a* and two side posts 121*b*. The second magnetic part 122 also has a central post 122*a* and two side posts 122*b*. As such, the first magnetic part 121 and the second magnetic part 122 of the magnetic core assembly 12 are cooperatively formed as an EE-type core assembly.

For assembling the inductor 1, the central post 121*a* of the first magnetic part 121 and the central post 122*a* of the second magnetic part 122 are aligned with the channel 112 and embedded into the channel 112. In addition, the side posts 121*b* of the first magnetic part 121 are contacted with the side posts 122*b* of the second magnetic part 122. As such, the coils 13 will interact with the magnetic core assembly 12 to achieve the function of inductor. The resulting structure of the assembled inductor 1 is schematically shown in FIG. 1B.

For controlling inductance of the inductor 1, the distance between the central post 121*a* of the first magnetic part 121 and the central post 122*a* of the second magnetic part 122 should be adjusted such that the air gap of the inductor 1 is changed. For achieving the purpose, portions of the central posts 121*a* and 122*a* are scraped by a tool such that central post 121*a*/122*a* is shorter than the side post 121*b*/122*b* by $d_0$ (as shown in FIG. 1A). Under this circumstance, after the central post 121*a* of the first magnetic part 121 and the central post 122*a* of the second magnetic part 122 are embedded into the channel 112, the central post 121*a* is distant from the central post 122*a* by a gap of $2\times d_0$. Due to the gap, the inductance of the inductor 1 is adjusted.

The process of fabricating the inductor 1 has some drawbacks. For example, since the side posts 121*b* and 122*b* are disposed at bilateral sides of the central posts 121*a* and 122*a*, the side posts 121*b* and 122*b* become hindrance from scraping the central posts 121*a* and 122*a*. Especially when a longer gap is required, the process of scraping the central posts 121*a* and 122*a* is time consuming and complicated. In addition, since the side posts 121*b* of the first magnetic part 121 are contacted with the side posts 122*b* of the second magnetic part 122, the volume of the inductor 1 is very bulky.

Therefore, there is a need of providing an improved magnetic element so as to obviate the drawbacks encountered from the prior art.

SUMMARY OF THE INVENTION

An object of the present invention provides a magnetic element having increased air gap between two central posts of the magnetic core assembly so as to adjust the inductance of the magnetic element.

Another object of the present invention provides a magnetic element having reduced volume.

A further object of the present invention provides a magnetic element whose central posts are easily scraped off without being hindered by the side posts, thereby reducing fabricating time and cost.

In accordance with an aspect of the present invention, there is provided a magnetic element. The magnetic element includes a conducting winding structure, a first magnetic part, a second magnetic part, a first side post and a second side post. The first magnetic part has a first central post. The second magnetic part has a second central post. The first side post is disposed on an edge of the first magnetic part or the second magnetic part. The second side post is disposed on another edge of the first magnetic part or the second magnetic part where no side post is disposed or the first side post is not aligned with. The conducting winding structure is sandwiched between the first magnetic part and the second magnetic part. The first central post is aligned with the second central post. The first and second side posts are aligned with corresponding edges wherein no side post is disposed. As a result, the overall height of the first central post and the second central post is less than the height of the first side post or the second side post and an air gap is defined between the first central post and the second central post.

In accordance with another aspect of the present invention, there is provided a magnetic element. The magnetic element includes a conducting winding structure, a first magnetic part and a second magnetic part. The first magnetic part has a first central post and multiple side posts. The second magnetic part has a second central post and multiple edges. The conducting winding structure is sandwiched between the first magnetic part and the second magnetic part. The first central post is aligned with the second central post. The side posts of the first magnetic part are aligned with corresponding edges of the second magnetic part wherein no side post is disposed. As a result, the overall height of the first central post and the second central post is less than the height of the side post and an air gap is defined between the first central post and the second central post.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
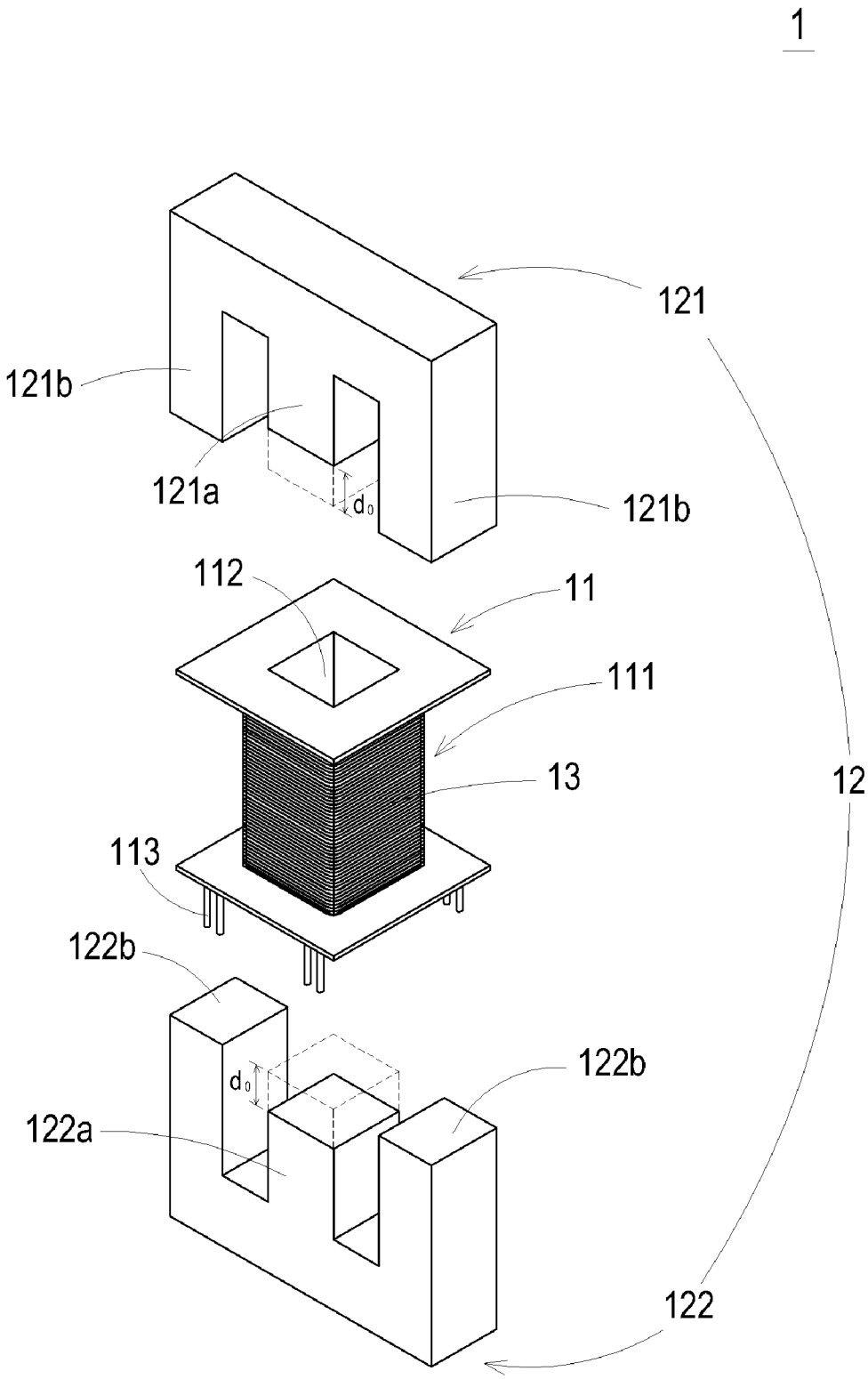
FIG.1A PRIOR ART
FIG. 1A is a schematic exploded view of a conventional inductor.
Figure 1B:
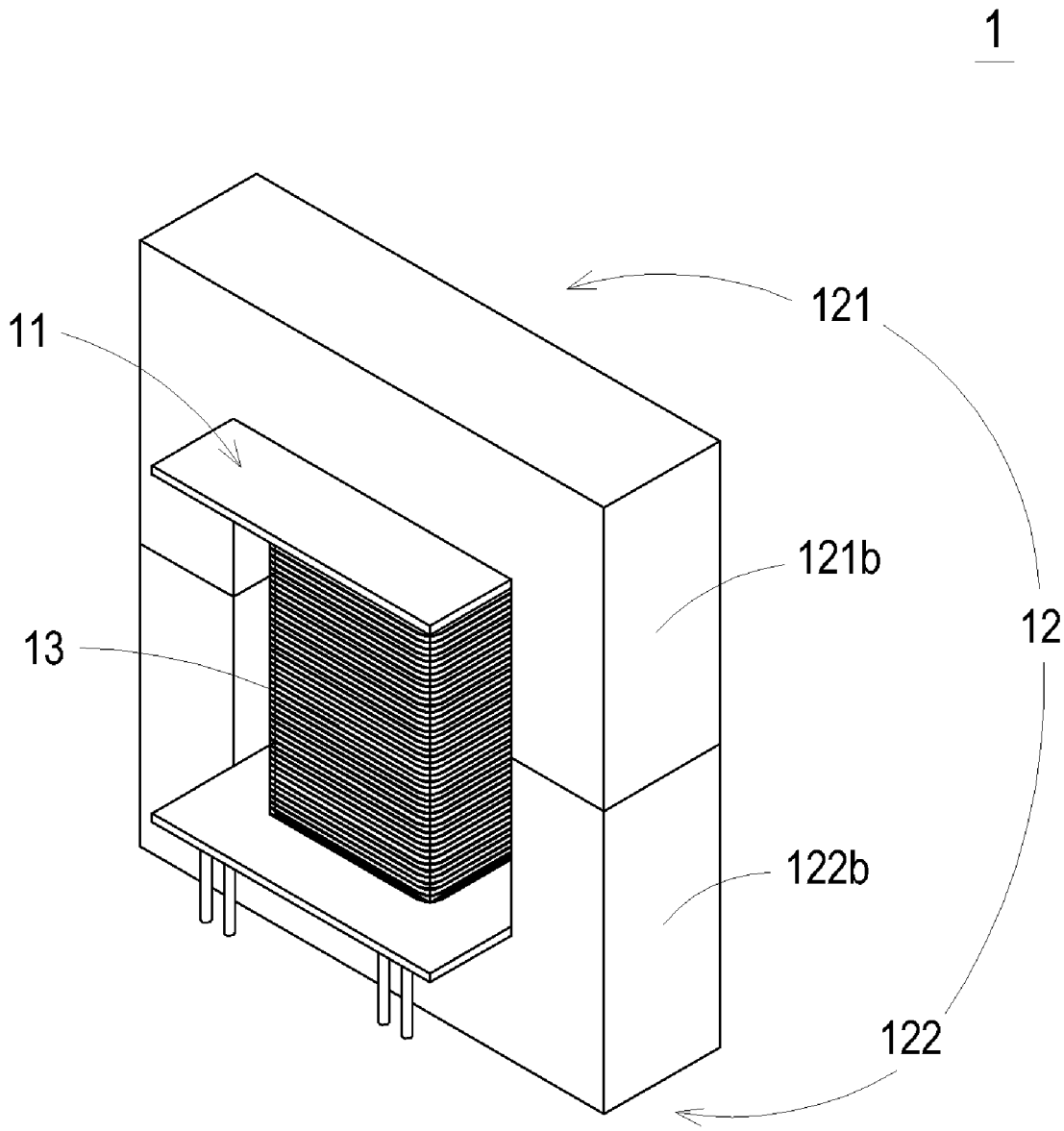
FIG.1B PRIOR ART
FIG. 1B is a schematic assembled view of a conventional inductor.
Figure 2A:
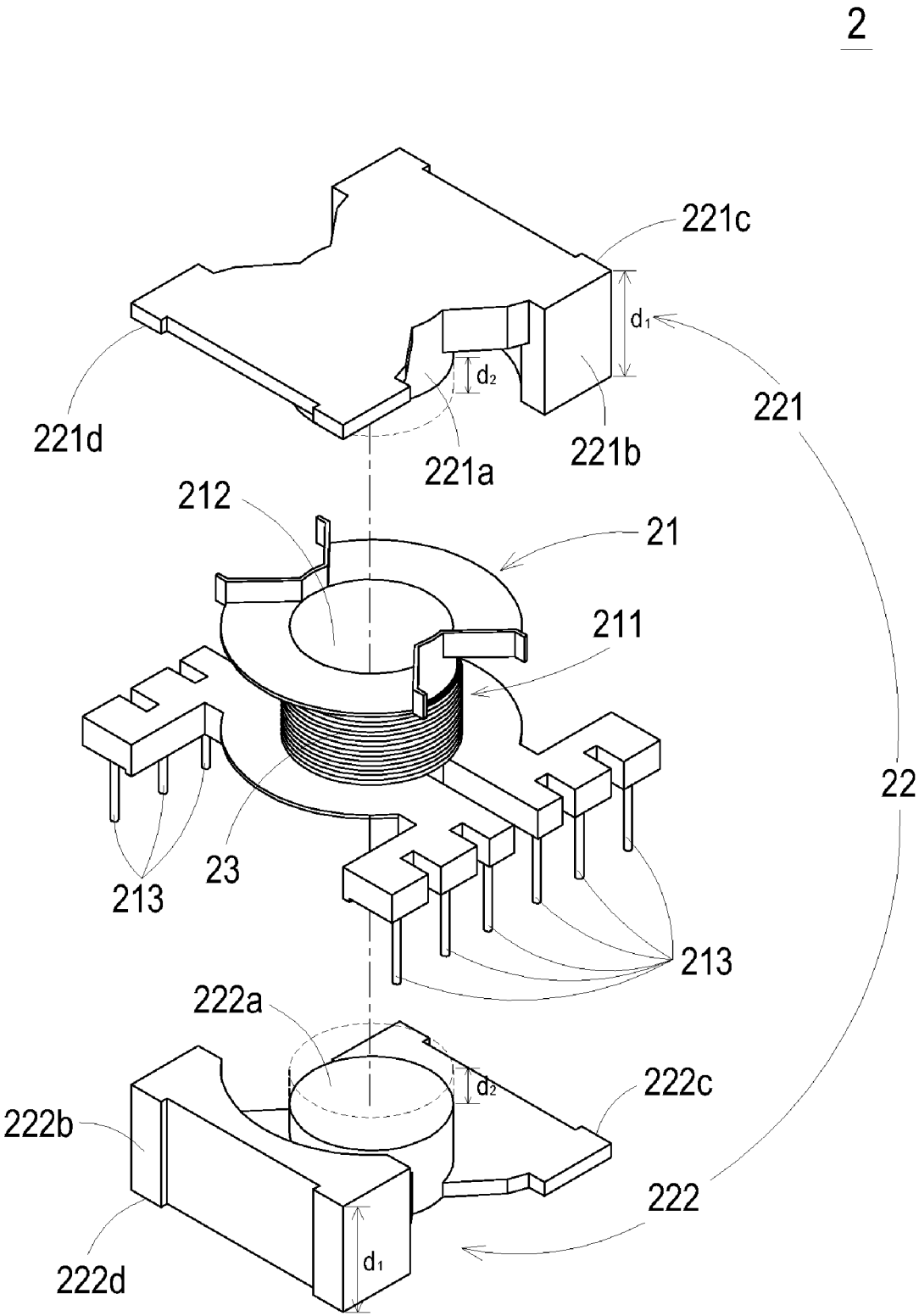
FIG. 2A is a schematic exploded view illustrating a magnetic element according to a first preferred embodiment of the present invention.
Figure 4:
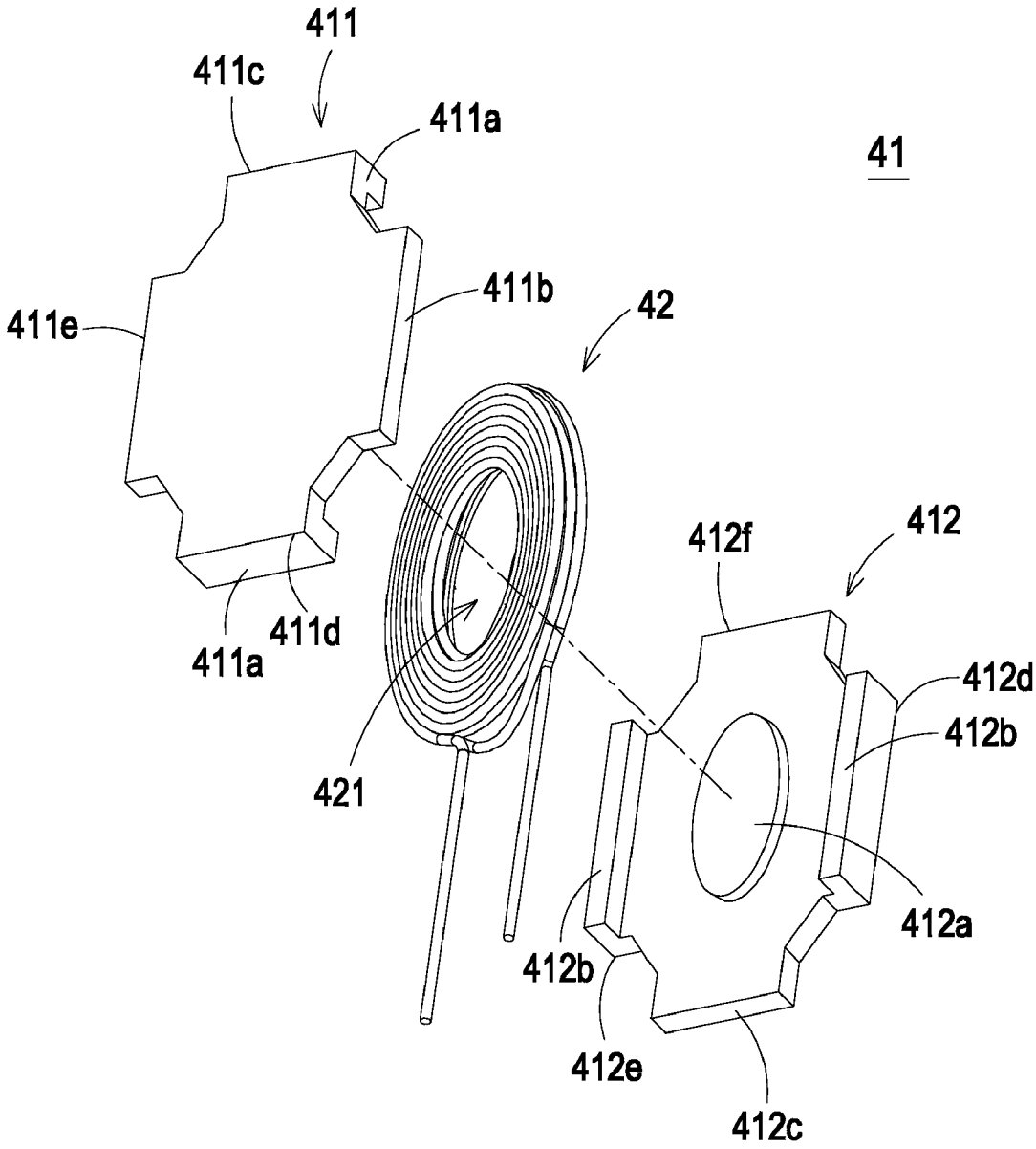
FIG. 4 is a schematic exploded view illustrating a magnetic core assembly used in the magnetic element according to a third preferred embodiment of the present invention.

FIG. 2A is a schematic exploded view illustrating a magnetic element according to a first preferred embodiment of the present invention. The magnetic element 2 principally comprises a conductive winding structure and a magnetic core assembly 22. The conductive winding structure includes a bobbin 21 and a coil 23 wound around the bobbin 21. Alternatively, the conductive winding structure is a coil pancake 42 (as shown in FIG. 4) by winding a conductive wire. The bobbin 21 has a winding section 211 for winding the coil 23 thereon. The bobbin 21 further has a channel 212 running through a center portion thereof. In addition, the bobbin 21 has several pins 213 that is extended from the bottom surface thereof and connected to the coil 23. By soldering the pins 213 on a circuit board (not shown), the magnetic element 2 is mounted on and electrically connected to the circuit board. The circuit board is a system circuit board or an auxiliary circuit board.

The magnetic core assembly 22 includes a first magnetic part 221 and a second magnetic part 222. The first magnetic part 221 has a first central post 221*a* and a first side post 221*b*. It is preferred that the first central post 221*a* and the first side post 221*b* are integrally formed on the first magnetic part 221. The first side post 221*b* is disposed on a first edge 221*c* of the first magnetic part 221 and aligned with a third edge 222*c* of the second magnetic part 222. The first central post 221*a* is shorter than the first side post 221*b* by a length d2. The second magnetic part 222 has a second central post 222*a* and a second side post 222*b*. It is preferred that the second central post 222*a* and the second side post 222*b* are integrally formed on the second magnetic part 222. The second side post 222*b* of the second magnetic part 222 is disposed on a second edge 222*d* and aligned with a fourth edge 221*d* of the first magnetic part 221. Likewise, the second central post 222*a* is shorter than the second side post 222*b* by a length d2. In addition, the height of the first side post 221*b* of the first magnetic part 221 is equal to the height of the second side post 222*b* of the second magnetic part 222 (=d1).

Figure 2B:
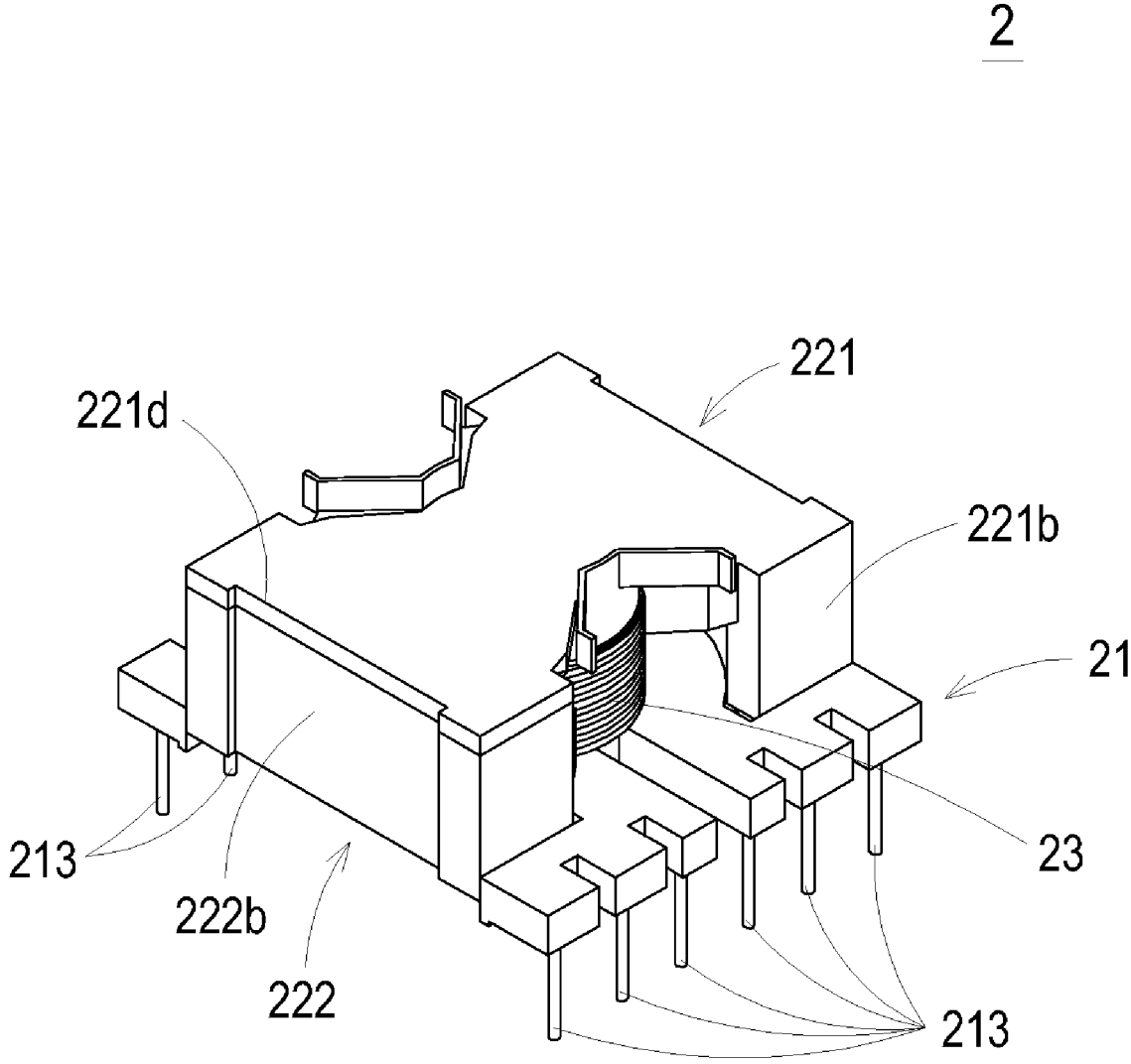
FIG. 2B is a schematic assembled view of the magnetic element shown in FIG. 2A.

Please refer to FIGS. 2A and 2B. For assembling the magnetic element 2, the central post 221*a* of the first magnetic part 221 and the central post 222*a* of the second magnetic part 222 are aligned with the channel 212 and embedded into the channel 212. In addition, the first side post 221*b* of the first magnetic part 221 is contacted with the third edge 222*c* of the second magnetic part 222; and the second side post 222*b* of the second magnetic part 222 is contacted with the fourth edge 221*d* of the first magnetic part 221. As such, the coils 23 on the bobbin 21 will interact with the first magnetic part 221 and the second magnetic part 222 of the magnetic core assembly 22 to achieve the purpose of voltage regulation. The resulting structure of the assembled magnetic element 2 is schematically shown in FIG. 2B.

After the first central post 221*a* of the first magnetic part 221 and the second central post 222*a* of the second magnetic part 222 are embedded into the channel 212 of the bobbin 21, the first central post 221*a* is distant from the second central post 222*a* by an air gap. Due to the air gap, the inductance of the magnetic element 2 is increased. Since the first side posts 221*b* and the second side post 222*b* are respectively disposed on the third edge 222*c* and fourth edge 221*d* where no side post is disposed, the overall thickness of the assembled magnetic element 2 is substantially equal to the height d1 of the first side post 221*b* or the second side post 222*b*. In comparison with the conventional inductor, the magnetic element 2 of the present invention is very slim in thickness and thus the overall volume of the magnetic element 2 is largely reduced. Moreover, the inductance of the magnetic element 2 is adjustable by changing the air gap between the first central post 221*a* and the second central post 222*a*. Generally, as the air gap is increased, the inductance of the magnetic element 2 is reduced.

Since no side post is disposed on the fourth edge 221*d* of the first magnetic part 221, a portion of the first central post 221*a* may be scraped off by moving the scraping tool forwardly and backwardly through the fourth edge 221*d*. Similarly, since no side post is disposed on the third edge 222*c* of the second magnetic part 222, a portion of the second central post 222*a* may be scraped off by moving the scraping tool forwardly and backwardly through the third edge 222*c*. As a consequence, the processes of scraping the first central post 221*a* and the second central post 222*a* are simplified and time-saving.

An example of the magnetic element 2 includes but is not limited to an inductor or a transformer. In a case that the magnetic element 2 is a transformer, the magnetic element 2 further includes a secondary winding coil (not shown). As such, the conductive winding structure and the secondary winding coil interact with the magnetic core assembly 22 to achieve the purpose of voltage regulation.

Figure 3:
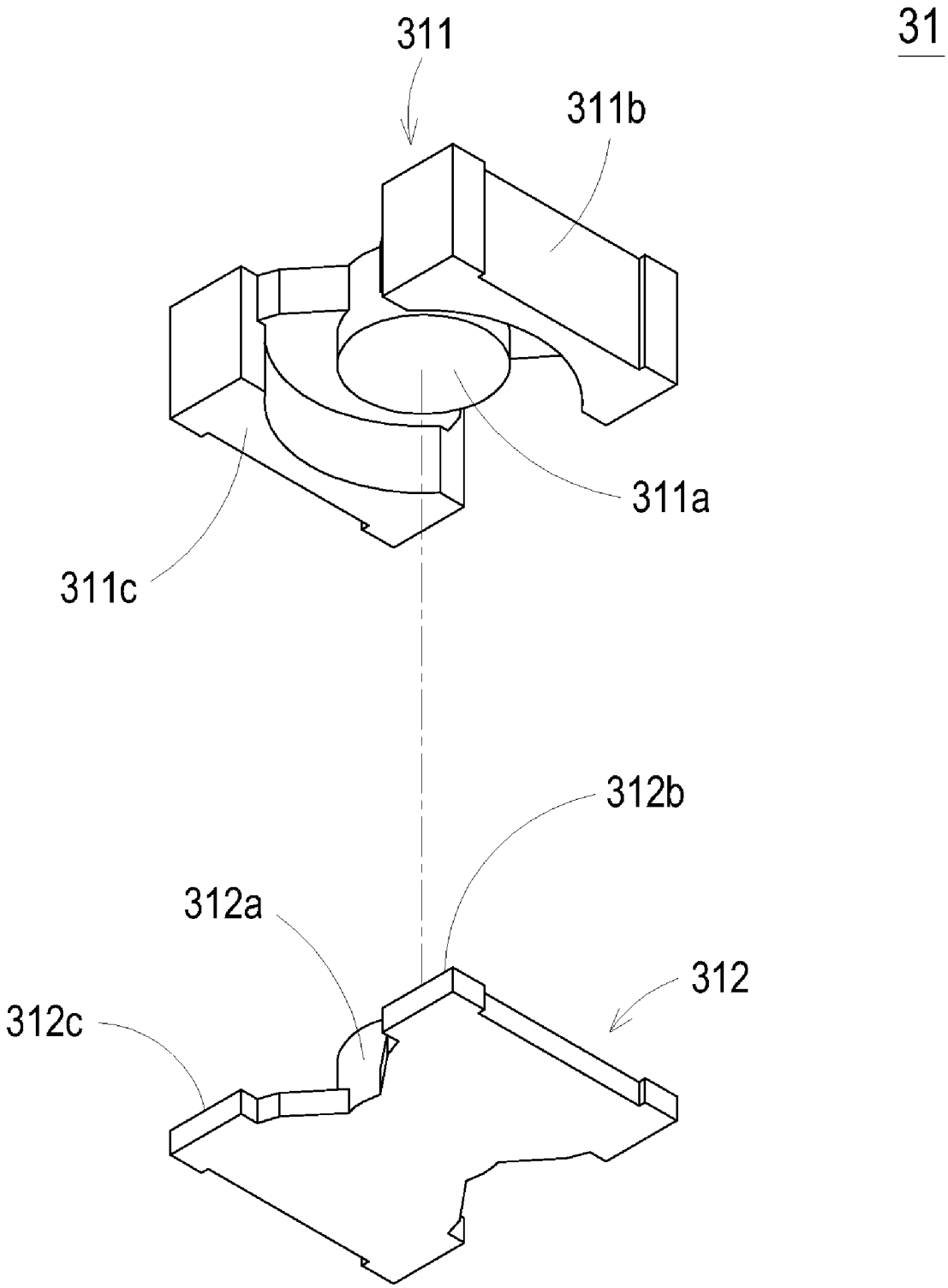
FIG. 3 is a schematic exploded view illustrating a magnetic core assembly used in the magnetic element according to a second preferred embodiment of the present invention.

FIG. 3 is a schematic exploded view illustrating a magnetic core assembly used in the magnetic element according to a second preferred embodiment of the present invention. The magnetic core assembly 31 includes a first magnetic part 311 and a second magnetic part 312. The first magnetic part 311 has a first central post 311*a*, a first side post 311*b* and a second side post 311*c*. The height of the first side post 311*b* is equal to the height of the second side post 311*c*. The second magnetic part 312 has a second central post 312*a*. The second magnetic part 312 has a first edge 312*b* and a second edge 312*c* corresponding to the first side post 311*b* and the second side post 311*c* of the first magnetic part 311, respectively. The overall height of the first central post 311*a* and the second central post 312*a* is less than the height of the first side post 311*b* or the second side post 311*c*. After the first central post 311*a* of the first magnetic part 311 and the second central post 312*a* of the second magnetic part 312 are embedded into the channel of the bobbin (as shown in FIG. 2A), the first central post 311*a* is distant from the second central post 312*a* by an air gap (not shown). In addition, the first side post 311*b* and the second side post 311*c* of the first magnetic part 311 are contacted with the first edge 312*b* and the second edge 312*c*, respectively. The overall thickness of the assembled magnetic core assembly 31 is substantially equal to the height of the first side post 311*b* plus the thickness of the first edge 312*b* (or the height of the second side post 311*c* plus the thickness of the second edge 312*c*). In comparison with the conventional inductor, the magnetic core assembly 31 of the present invention is very slim in thickness and thus the overall volume of the magnetic element is largely reduced. Moreover, the inductance of the magnetic element is adjustable by changing the air gap between the first central post 311*a* and the second central post 312*a*.

In the above embodiments, the locations of the side posts of the magnetic core assembly are not restricted as long as the side posts are contacted with edges of the first magnetic part and/or the second magnetic part where no side post is disposed and the overall volume of the magnetic element is reduced.

FIG. 4 is a schematic exploded view illustrating a magnetic core assembly used in the magnetic element according to a third preferred embodiment of the present invention. The magnetic core assembly 41 includes a first magnetic part 411, a second magnetic part 412 and the coil pancake 42. The first magnetic part 411 and the second magnetic part 412 substantially have rectangular profiles. The first magnetic part 411 comprises a first central post 411*f* (as shown in FIG. 5B), two side posts 411*a* and four edges 411*b*, 411*c*, 411*d* and 411*e*. The side posts 411*a* are disposed on two opposite edges 411*c* and 411*d*. Alternatively, the side posts 411*a* are disposed on the two adjacent edges. No side post is disposed on the other two edges 411*b* and 411*e*. The second magnetic part 412 comprises a second central post 412*a*, two side posts 412*b* and four edges 412*c*, 412*d*, 412*e* and 412*f*. The two side posts 412*b* are disposed on two opposite edges 412*d* and 412*e*, which are respectively aligned with the edges 411*b* and 411*e* of the first magnetic part 411. The height of the side post 411*a* of the first magnetic part 411 is substantially equal to the height of the side post 412*b* of the second magnetic part 412. At least one of the first central post 411*f* and the second central post 412*a* is shorter than the side posts 411*a* and 412*b*. In addition, the overall height of the first central post 411*f* and the second central post 412*a* is less than the height of the side post 411*a* or 412*b*. For assembling the magnetic element 41, the first central post 411*f* of the first magnetic part 411 and the second central post 412*a* of the second magnetic part 412 are aligned with the channel 421 formed in the center portion of the coil pancake 42 and embedded into the channel 421 of the coil pancake 42, the first central post 411*f* is distant from the second central post 412*a* by an air gap (not shown). In addition, the side posts 411*a* and 412*b* are contacted with the edges 412*c*, 412*f*, 411*b* and 411*e*, respectively. The overall thickness of the assembled magnetic core assembly 41 is substantially equal to the height of the side post (411*a* or 412*b*) plus the thickness of one of the edges 412*c*, 412*f*, 411*b* and 411*e*. In comparison with the conventional inductor, the magnetic core assembly 41 of the present invention is very slim in thickness and thus the overall volume of the magnetic element is largely reduced. Moreover, the inductance of the magnetic element is adjustable by changing the air gap between the first central post 411*f* and the second central post 412*a*. Moreover, since no side post is disposed on the edges 411*b*, 411*e*, 412*c* and 412*f*, portions of the central posts 411*f* and 412*a* may be scraped off by moving the scraping tool forwardly and backwardly through the edges 411*b*, 411*e*, 412*c* and 412*f*. As a consequence, the processes of scraping the central posts 411*f* and 412*a* are simplified and time-saving.

Figure 5A:
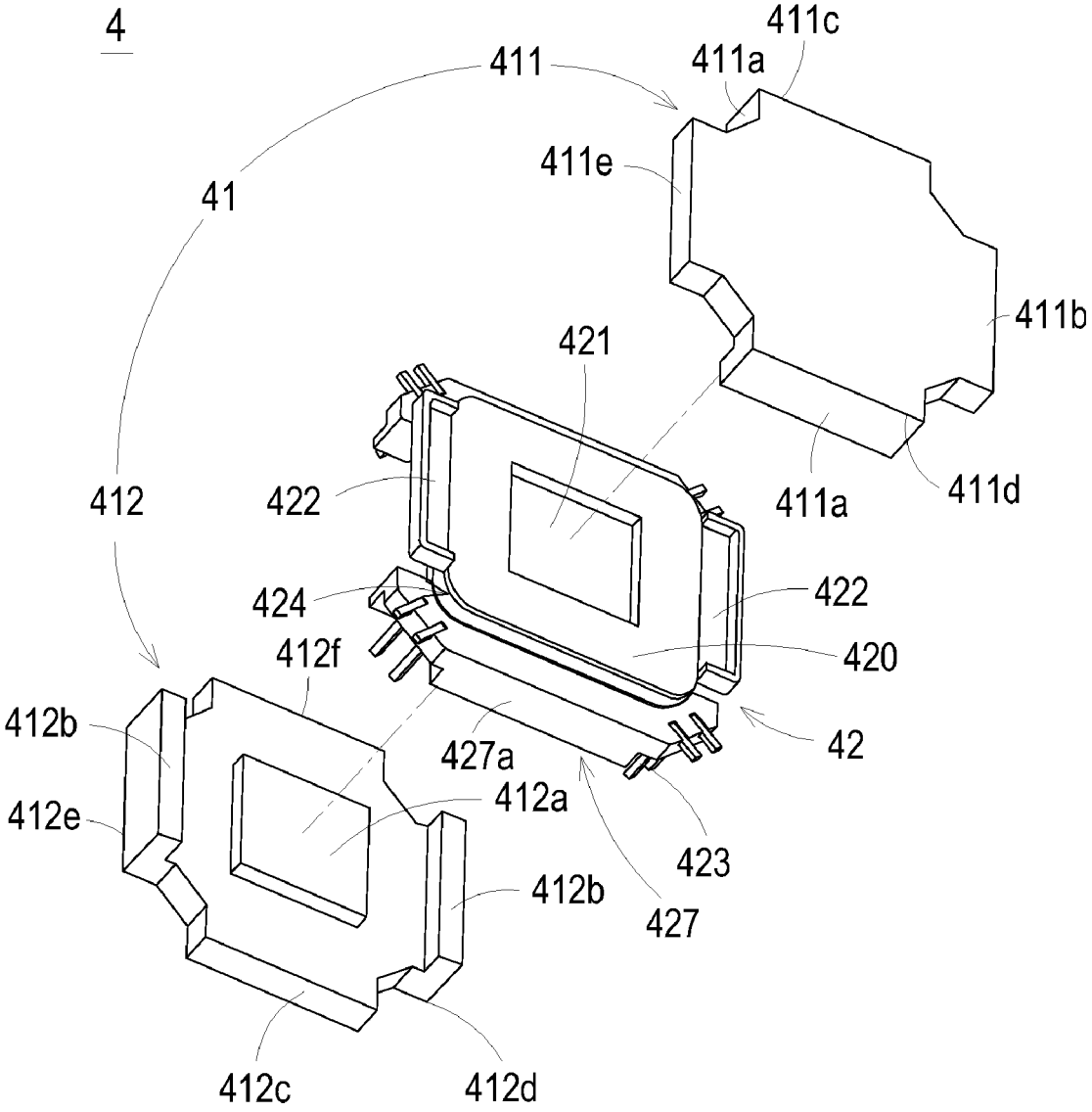
FIGS. 5A and 5B are schematic exploded views illustrating a magnetic element having the magnetic core assembly shown in FIG. 4 and taken from different viewpoints.
Figure 5B:
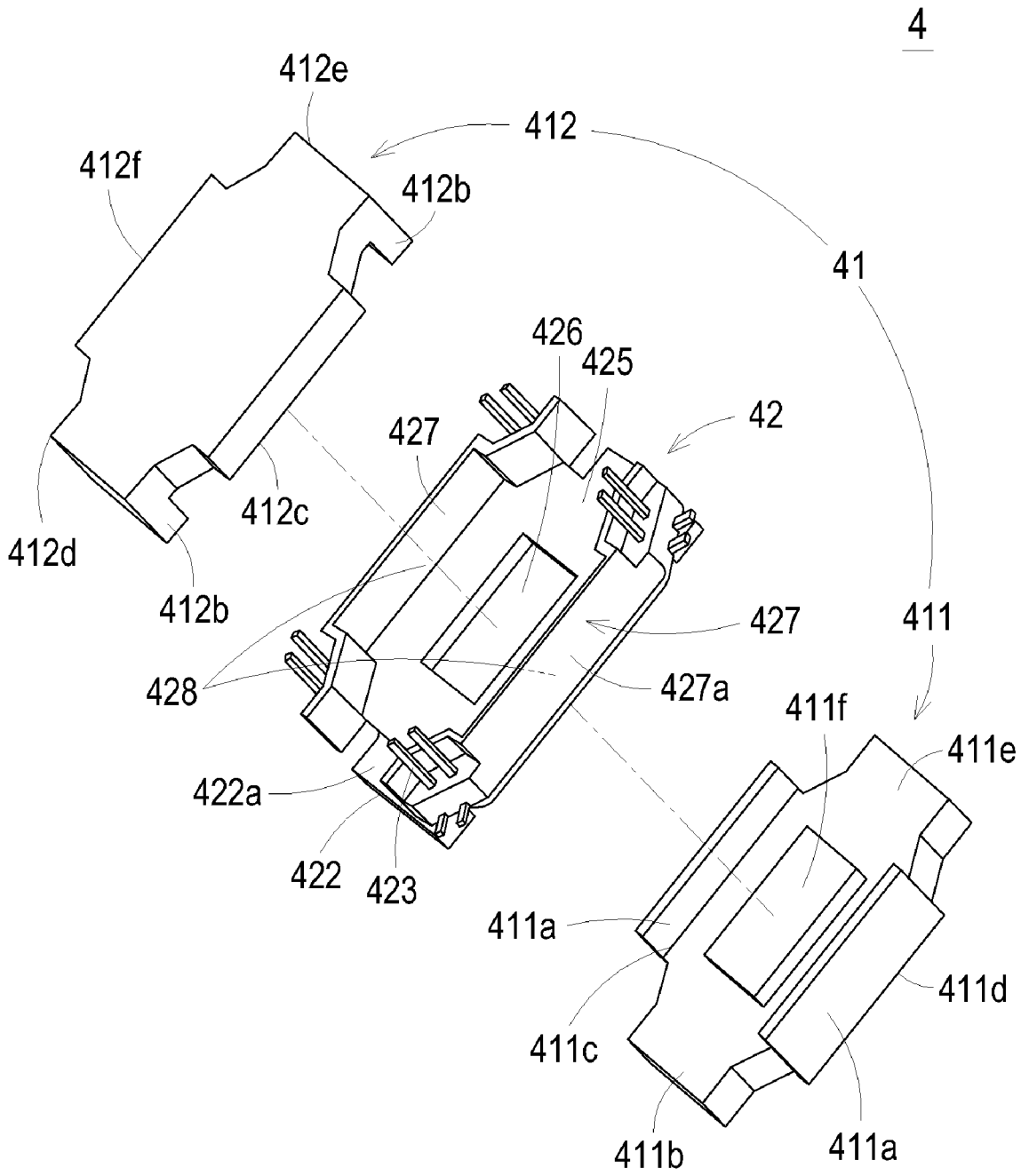

FIGS. 5A and 5B are schematic exploded views illustrating a magnetic element having the magnetic core assembly shown in FIG. 4 and taken from different viewpoints. The magnetic element 4 principally comprises a magnetic core assembly 41, a bobbin 42 and a coil (not shown). The bobbin 42 has a winding section 424 for winding the coil thereon. The bobbin 42 has a first surface 420 and a second surface 425. A first receiving portion 421 is formed in the first surface 420 of the bobbin 42 for receiving the first central post 411*f* therein (as shown in FIG. 5B). A second receiving portion 426 is formed in the second surface 425 of the bobbin 42 for receiving the second central post 412*a* therein (as shown in FIG. 5B). In addition, two third receiving portions 422 are formed at bilateral sides of the first surface 420 for receiving the edges 411*b* and 411*e* of the first magnetic part 411 therein. Two sidewalls 427 are extended downwardly from the other two sides of the bobbin 42. The bobbin 42 further has multiple pins 413, which are disposed on four corners of the rectangular bobbin 42. By soldering the pins 413 on a circuit board (not shown), the magnetic element 4 is mounted on and electrically connected to the circuit board. The circuit board is a system circuit board or an auxiliary circuit board.

Figure 5C:
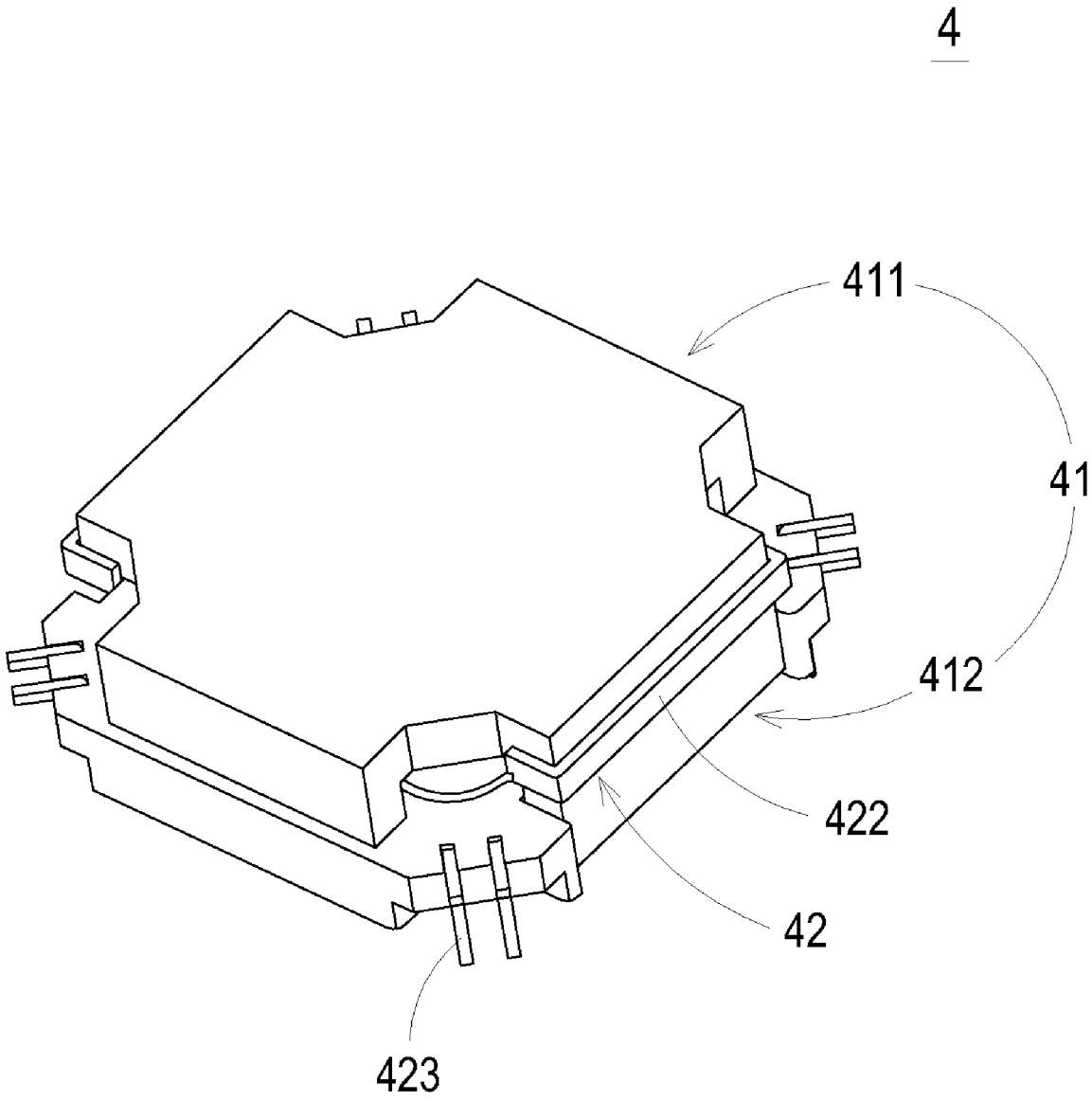
FIG. 5C is a schematic assembled view of the magnetic element shown in FIG. 5A.

Please refer to FIGS. 5A and 5B again. For assembling the magnetic element 4, the first central post 411*f* of the first magnetic part 411 is embedded into the first receiving portion 421 of the bobbin 42, and the second central post 412*a* of the second magnetic part 412 is embedded into the second receiving portion 426 of the bobbin 42. As such, the edges 411*b* and 411*e* of the first magnetic part 411 are received in the third receiving portions 422 of the bobbin 42, the side posts 411*a* of the first magnetic part 411 are contacted with the external surfaces 427*a* of the sidewalls 427 of the bobbin 42, and the side posts 412*b* of the second magnetic part 412 are sustained against the bottom surfaces of the receiving portions 422 of the bobbin 42. The resulting structure of the assembled magnetic element 4 is schematically shown in FIG. 5C. Next, the magnetic element 4 is clamped by a jig (not shown) and then mounted on a circuit board (not shown) such as a system circuit board or an auxiliary circuit board. Since the first magnetic part 411 and the second magnetic part 412 are separated by the bobbin 42, the first central post 411*f* of the first magnetic part 411 is distant from the second central post 412*a* of the second magnetic part 412 by an air gap (not shown). Moreover, the inductance of the magnetic element 4 is adjustable by changing the air gap between the first central post 411*f* and the second central post 412*a*. Since the edges 411*b* and 411*e* of the first magnetic part 411 are received in the third receiving portions 422 of the bobbin 42 and the edges 412*c* and 412*f* of the second magnetic part 412 are received in the fourth receiving portions 428 of the bobbin 42, the first central post 411*f* is separated from the second central post 412*a* by the bobbin 42, the side posts 412*b* of the second magnetic part 412 are separated from the edges 411*b* and 411*c* of the first magnetic part 411 by the bobbin 42, and the side posts 411*a* of the first magnetic part 411 are separated from the edges 412*c* and 412*f* of the second magnetic part 412 by the bobbin 42. Under this circumstance, the air gap between the first central post 411*f* and the second central post 412*a* is further increased by changing the thickness of the bobbin 42. In other words, only small portions of the first central post 411*f* and the second central post 412*a* needs to be scraped off and thus the processes of scraping the central posts 411*f* and 412*a* are simplified.

In the above embodiments, the locations of the side posts of the magnetic core assembly may be varied according to the practical requirements. For example, each of the rectangular magnetic parts may have two or more side posts as long as each side post is aligned and contacted with an edge of a corresponding magnetic part where no side post is disposed. Moreover, the rectangular magnetic parts may have arbitrary profiles such as octagonal profiles.

From the above description, the magnetic element of the present invention comprises a conductive winding structure, a first magnetic part and a second magnetic part. Since the side posts of the first magnetic part and the second magnetic part are aligned with the edges of a corresponding magnetic part where no side post is disposed, the overall volume of the magnetic element is largely reduced. Moreover, the inductance of the magnetic element is adjustable by changing the air gap between the first central post of the first magnetic part and the second central post of the second magnetic part. Moreover, the processes of fabricating the first magnetic part and the second magnetic part are simplified and time-consuming in comparison with the prior art. As a consequence, the magnetic element of the present invention is small-sized and easily assembled.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A magnetic element comprising:

a conducting winding structure;

a first magnetic part having a first central post;

a second magnetic part having a second central post;

two first side posts disposed on two first edges of said first magnetic part; and two second side posts disposed on two second edges of said second magnetic part;

wherein said conducting winding structure is sandwiched between said first magnetic part and said second magnetic part, said first central post is aligned with said second central post and both of said first central post and said second central post penetrate through said conducting winding structure, said first side posts are aligned and in contact with two corresponding third edges of said second magnetic part, said second side posts are aligned and in contact with two corresponding fourth edges of said first magnetic part, and no side post is disposed on said third edges of said second magnetic part nor said fourth edges of said first magnetic part, so that said first side posts and said second side posts are disposed outside said conducting winding structure and the overall height of said first central post and said second central post is less than the height of said first side posts or said second side posts, thereby an air gap is defined between said first central post and said second central post.

2. The magnetic element according to claim 1 wherein said first central post is integrally formed on said first magnetic part and said second central post is integrally formed on said second magnetic part.

3. The magnetic element according to claim 1 wherein each of said first side post and said second side post is integrally formed on said first magnetic part or said second magnetic part, respectively.

4. The magnetic element according to claim 1 wherein said conducting winding structure is a coil pancake.

5. The magnetic element according to claim 1 wherein said conducting winding structure includes a bobbin and a coil wound around said bobbin.

6. The magnetic element according to claim 5 wherein said bobbin comprises a first receiving portion and a second receiving portion for respectively receiving said first central post and said second central post therein.

7. The magnetic element according to claim 6 wherein said bobbin further comprises a third receiving portion and a fourth receiving portion for respectively receiving edges of said first magnetic part and said second magnetic part therein.

8. The magnetic element according to claim 1 wherein said magnetic element is an inductor or a transformer.

9. The magnetic element according to claim 1 wherein said first central post is shorter than each of said first and second side posts.

10. The magnetic element according to claim 1 wherein said second central post is shorter than each of said first and second side posts.

* * * * *